United States Patent [19]

Gates et al.

[11] 4,006,837

[45] Feb. 8, 1977

[54] CONTAINER CLOSURE

[75] Inventors: Gerald G. Gates, Wheeling, W. Va.; Charles J. Hasper, Jr., Bellaire, Ohio; Milton H. McCann, Wheeling; Richard D. Francis, Moundsville, both of W. Va.

[73] Assignee: Wheeling Closure Corporation, Wheeling, W. Va.

[22] Filed: Oct. 30, 1974

[21] Appl. No.: 519,259

[52] U.S. Cl. ..... 215/340; 215/333; 220/294; 220/293

[51] Int. Cl.[2] ..... B65D 41/04

[58] Field of Search ..... 215/332, 333, 339, 340; 220/293, 294, 296, 298

[56] References Cited

UNITED STATES PATENTS

| | | | |
|---|---|---|---|
| 1,153,897 | 9/1915 | Doldt | 215/340 |
| 1,300,252 | 4/1919 | Doldt | 215/339 |
| 2,148,169 | 2/1939 | Merolle | 220/293 |
| 2,288,349 | 6/1942 | Gibbs | 215/340 |
| 2,540,931 | 2/1951 | Carvolno | 215/31 |
| 2,542,648 | 2/1951 | Flowers | 220/293 |
| 2,626,726 | 1/1953 | Burkhardt | 220/294 |
| 3,122,260 | 2/1964 | Ryan | 220/294 |
| 3,516,565 | 6/1970 | Hatkevich | 215/333 |
| 3,768,691 | 10/1973 | Cobb | 220/293 |

*Primary Examiner*—Ro E. Hart
*Attorney, Agent, or Firm*—Brady, O'Boyle & Gates

[57] ABSTRACT

A container closure having a skirt portion provided with an inwardly rolled, continuous, reinforcing bead on the lower edge thereof and engageable with locking projections or threads provided on the container neck portion.

8 Claims, 7 Drawing Figures

CONTAINER CLOSURE

BACKGROUND OF THE INVENTION

Conventional container closures, particularly screw type caps for bottles or jars, either include a plurality of inwardly extending fingers adapted to engage a plurality of spaced lugs formed on the mouth of the jar, or a threaded portion on the cap engaging a cooperating threaded portion on the mouth of the jar. The first-mentioned type of cap is similar to a bayonet joint wherein a partial turn of the cap will either tighten the cap or loosen it, while the second-mentioned type of cap is a true threaded connection wherein the cap has to be rotated at least 360° in either one direction or the other depending upon whether the cap is being tightened or released from the jar.

Most of the jar caps marketed heretofore have been circular to conform to the circular neck of the jar; however, in today's market where the style of the jar and its associated closure have become distinctive to the advertising and commercial exploitation of the product contained within the jar, many jars are being manufactured to have a polygonal cross-section with a closure having a similar polygonal cross-section. In these types of jars and closures, the closure includes a circular cap having the bayonet or continuous threads noted above, and an attached housing having a polygonal, cross-section similar to the jar, the housing also having a relatively wide skirt portion confirming to the side walls of the jar.

While these "styled" jars and associated closures have been satisfactory for their intended purpose, they have been characterized as relatively expensive due to the fabrication of the closure which required a cap connected to a separate housing.

After considerable research and experimentation, the jar closure of the present invention has been devised which includes the cap and housing as a single unit which heretofore required separately attached components, viz., the cap and the housing.

The closure of the present invention comprises, essentially, a cap having a cross-section conforming to the cross-section of the jar to which the cap is attached, a relatively wide skirt portion conforming to, or providing an extension to the side walls of the jar, and a continuous, inwardly rolled bead formed on the lower edge of the skirt portion to not only reinforce the skirt portion of the cap but also to provide a continuous thread or finger engageable with the threads or lugs on the mouth of the jar.

Figure 1:
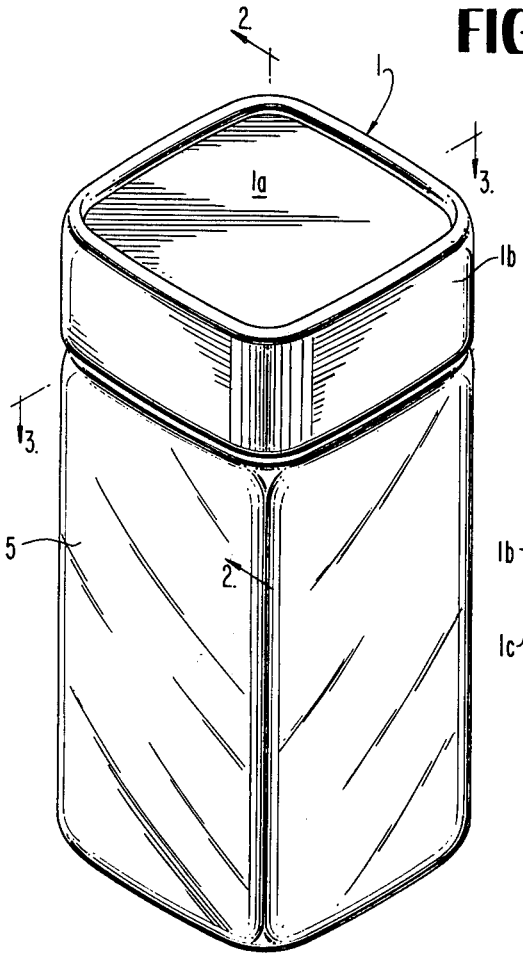
FIG. 1 is a perspective view of a jar having the closure of the present invention mounted thereon.
Figure 2:
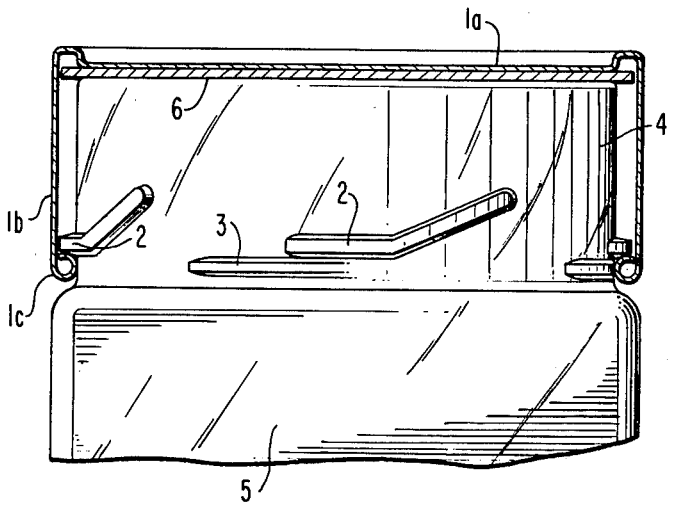
FIG. 2 is a fragmentary, sectional view taken along line 2—2 of FIG. 1.

Referring to the drawings and more particularly to FIGS. 1 to 4, the closure 1 of the present invention comprises a top wall portion 1*a* having a depending skirt portion 1*b*, the lower end of the depending skirt portion having a continuous, inwardly bent bead 1*c* adapted to engage a plurality of lugs or interrupted threads 2 and stop members 3 formed on the neck portion 4 of a jar 5. A sealing disc 6 is provided between the upper edge of the jar neck and the bottom surface of the closure top wall.

Figure 4:
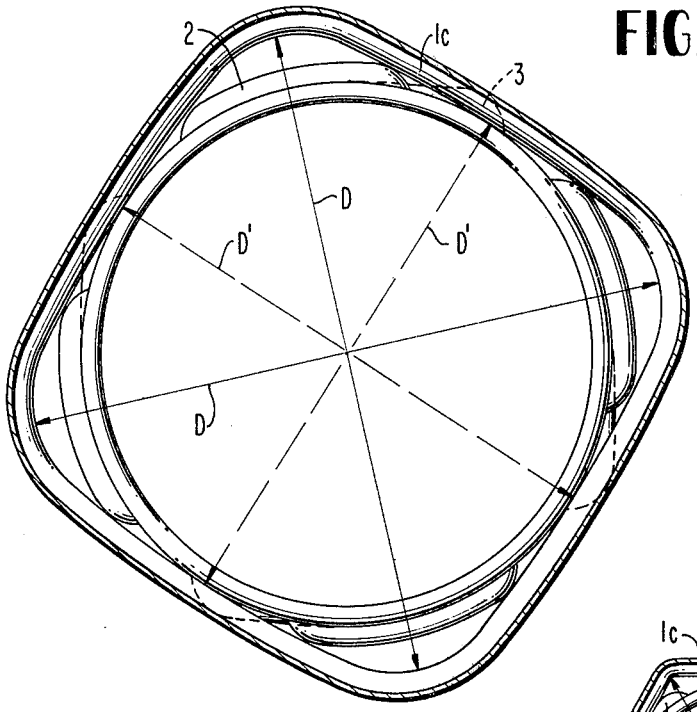
FIG. 4 is a sectional view similar to FIG. 3 showing the closure placed on the bottle prior to being turned to the closed or locked position as shown in FIG. 3.

To mount the closure or cap 1 on the jar 5, as will be seen in FIG. 4, the cap is first oriented so that the widest radial dimension D of the cap is aligned with the interrupted threads 2. While so disposed, the radial dimension D of the cap is greater than the corresponding radial dimension of the threads so that the bead 1*c* of the cap is spaced outwardly from the threads 2.

Figure 3:
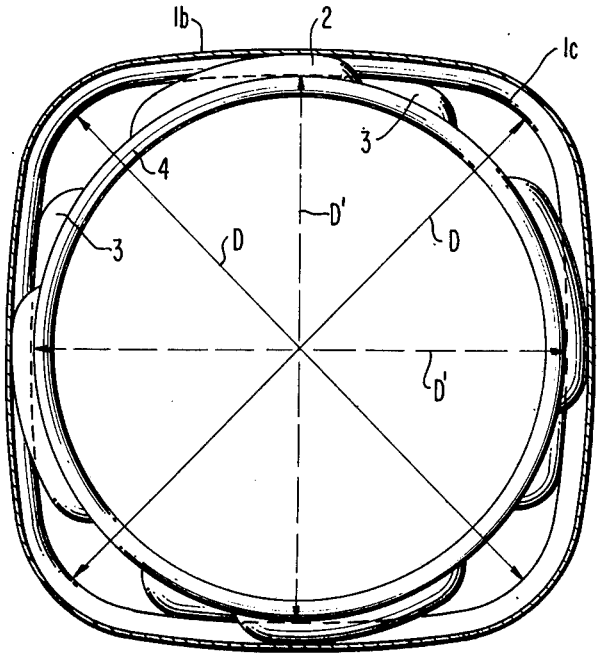
FIG. 3 is a sectional view taken along line 3—3 of FIG. 1.

To tighten the cap on the jar, the cap is turned to the position shown in FIG. 3. In this position, the shortest radial dimension D′ of the cap is less than the corresponding radial position of the interrupted threads 2 so that the portion of the bead 1*c* at the shortest radial dimension D′ underlies the interrupted threads and abuts the stop members 3.

Figure 5:
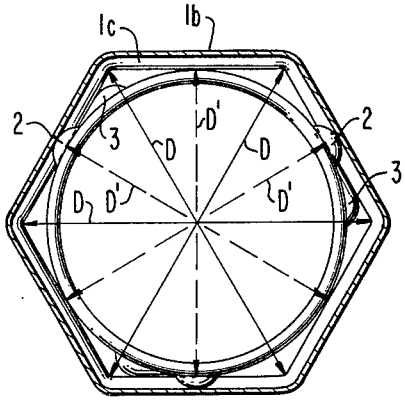
FIG. 5 is a view similar to FIG. 3 but illustrating a closure having a hexagonal cross-section.
Figure 6:
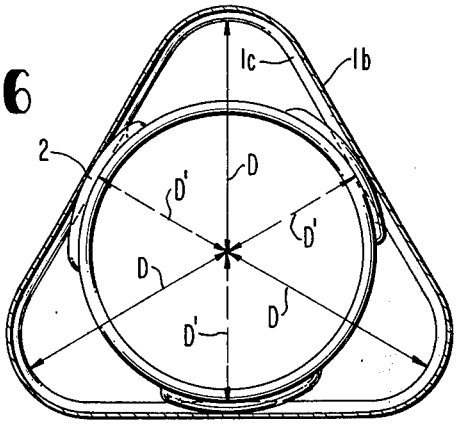
FIG. 6 is a view similar to FIG. 3 but illustrating a closure having a triangular cross-section.

While the present invention has been described in connection with a rectangular or square cap, the concept can also be applied to caps having other polygonal configurations such as hexagonal (FIG. 5) and triangular (FIG. 6), the underlying principle being that the cap be constructed and arranged to have a widest radial dimension D greater than the corresponding radial dimensions of the interrupted threads on the jar, and a shortest radial dimension D′ less than the corresponding radial dimensions of the interrupted threads.

Figure 7:
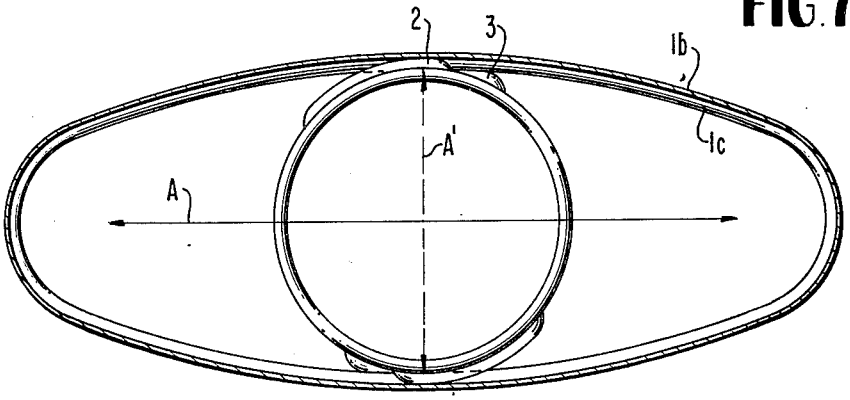
FIG. 7 is a view similar to FIG. 3 but illustrating a closure having an elliptical cross-section.

FIG. 7 illustrates the principle of the present invention applied to a cap having an elliptical cross-section. In this embodiment, to secure the cap to the jar, the cap would first be oriented so that the major axis A is disposed normal to the position shown in FIG. 7 whereby the cap bead would extend radially outwardly from the jar threads. To tighten the cap, it would be turned so that the portion of the bead along the minor axis A′ would underlie the threads as shown in FIG. 7.

It will be appreciated by those skilled in the art that by dimensioning the cap to have portions wider and shorter than the radial dimensions of the threads, it follows that the cap can be constructed to have a continuous bead formed on the lower end of the skirt since the widest dimension of the cap allows the cap to clear the threads when the cap is being placed on the jar, the shortest dimension of the cap cooperating with the threads in a binding action when the cap is turned to the tightened position. By being able to fabricate the cap with a continuous bead reduced manufacturing costs, and provides a greater reinforcement of the cap skirt than heretofore provided by caps having interrupted beads.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A container closure comprising a top wall, a continuous skirt portion depending from the perimeter of said top wall, a continuous reinforcing bead provided on the lower end of said skirt portion adapted to engage interrupted thread portions on a container, said reinforcing bead being of uniform thickness throughout its extent, a portion of said closure having a radial dimension greater than the corresponding radial dimension of the container thread portions, and another portion of said closure having a radial dimension less than the corresponding radial dimension of the container thread portions, whereby when applying the closure to the container the portion of the closure having the greater radial dimension is aligned with the thread portions to thereby position said portion radially outwardly from said threads, and by rotating said closure, the portion of the bead at the shorter radial dimension of the closure is caused to underlie and engage the container threads thereby tightening the closure on the container.

2. A container closure according to claim 1 wherein the plan configuration of said closure is polygonal.

3. A container closure according to claim 2 wherein the polygonal configuration is rectangular.

4. A container closure according to claim 2 wherein the polygonal configuration is hexagonal.

5. A container closure according to claim 2 wherein the polygonal configuration is triangular.

6. A container closure according to claim 1 wherein the plan configuration of said closure is elliptical.

7. A container closure according to claim 6 wherein the greater radial dimension of the closure is disposed on the major axis, and the shorter radial dimension is disposed on the minor axis.

8. A container closure according to claim 1 wherein the closure comprises a cap, and the threads are provided on the mouth portion of a jar.

* * * * *

UNITED STATES PATENT OFFICE

CERTIFICATE OF CORRECTION

Patent No. 4,006,837 Dated Feb. 8, 1977

Inventor(s) Gerald G. Gates et al.

It is certified that error appears in the above-identified patent and that said Letters Patent are hereby corrected as shown below:

Column 1, line 30, change "confirming" to -conforming-.

Column 2, line 54, after "bead" insert -having a uniform thickness throughout its extent-;
line 54, change "reduced" to -reduces-.

Signed and Sealed this

Nineteenth Day of April 1977

[SEAL]

*Attest:*

RUTH C. MASON
*Attesting Officer*

C. MARSHALL DANN
*Commissioner of Patents and Trademarks*